US007654659B2

(12) United States Patent
Harada et al.

(10) Patent No.: US 7,654,659 B2
(45) Date of Patent: Feb. 2, 2010

(54) CARRIAGE AND LIQUID EJECTING APPARATUS

(75) Inventors: Kazumasa Harada, Matsumoto (JP); Hiroyuki Sugimoto, Matsumoto (JP); Takashi Sato, Shibata-gun (JP)

(73) Assignee: Seiko Epson Corporation, Tokyo (JP)

( * ) Notice: Subject to any disclaimer, the term of this patent is extended or adjusted under 35 U.S.C. 154(b) by 421 days.

(21) Appl. No.: 11/761,220

(22) Filed: Jun. 11, 2007

(65) Prior Publication Data

US 2008/0068409 A1 Mar. 20, 2008

(30) Foreign Application Priority Data

Jun. 12, 2006 (JP) ..... 2006-162326

(51) Int. Cl.
*B41J 2/175* (2006.01)

(52) U.S. Cl. ..... 347/86; 347/20; 347/37

(58) Field of Classification Search ..... 347/20, 347/40, 85, 86
See application file for complete search history.

(56) References Cited

U.S. PATENT DOCUMENTS 6,749,287 B2 * 6/2004 Osada et al. ..... 347/50

FOREIGN PATENT DOCUMENTS

| | | |
|---|---|---|
| JP | 2000-127427 | 5/2000 |
| JP | 2003-266896 | 9/2003 |
| JP | 2004-351936 | 12/2004 |
| WO | 99-59823 | 11/1999 |

* cited by examiner

*Primary Examiner*—Thinh H Nguyen
(74) *Attorney, Agent, or Firm*—Workman Nydegger

(57) ABSTRACT

To easily form an excellent connection state between a terminal of an information storage medium in an ink cartridge and a contact of a carriage and, additionally, to reliably maintain the excellent connection state. A carriage includes an ink-cartridge receiving chamber for receiving an ink cartridge, an electronic substrate having a contact for connecting with an information storage medium of the ink cartridge, a mounting-position regulating portion for regulating the position of the ink cartridge with respect to a contact by regulating the mounting position of the ink cartridge in the ink-cartridge receiving chamber, and a head unit having a recording head. The mounting-position regulating portion is independent of the ink-cartridge receiving chamber so as to be freely removable and attachable with respect to the ink-cartridge receiving chamber in a state in which the electronic substrate is attached.

16 Claims, 9 Drawing Sheets

CARRIAGE AND LIQUID EJECTING APPARATUS

TECHNICAL FIELD

The present invention relates to a carriage on which a liquid cartridge is mountable and to a liquid ejecting apparatus including the carriage.

Examples of a liquid ejecting apparatus used herein include, but are not limited thereto, a recording apparatus that uses an ink jet recording head and discharges ink onto a target recording medium from the recording head to perform recording, such as a printer, copier, and facsimile machine. Other examples of such a liquid ejecting apparatus include an apparatus that ejects liquid for its application, instead of ink, onto a target ejecting medium corresponding to the target recording medium from an ejecting head corresponding to the ink jet recording head to cause the liquid to be attached to the target ejecting medium.

Examples of the liquid ejecting head include, in addition to the above-described recording head, a color-material ejecting head for use in production of a color filter for a liquid crystal display or other apparatuses, an electrode-material (conductive paste) ejecting head for use in formation of an electrode for an organic electroluminescent (EL) display, a surface emitting display (FED), or other apparatuses, a bioorganic-substance ejecting head for use in production of a biochip, and a sample ejecting head as a precision pipette.

BACKGROUND ART

One example of the liquid ejecting apparatus is an ink jet printer. The ink jet printer includes an ink jet recording head for discharging ink (hereinafter, abbreviated as a "recording head") on a carriage. The carriage has a substantially box shape and forms an ink cartridge receiving chamber for receiving an ink cartridge for supplying ink to the recording head.

A head unit including the recording head and an ink receiving portion that receives ink supplied from the ink cartridge is mounted on the bottom of the ink cartridge receiving chamber. A contact to be in contact with a terminal of an information storage medium (e.g., a non-volatile memory) storing various kinds of information about the ink cartridge (e.g., information on color and the amount of ink remaining) of the ink cartridge is disposed on a wall of the ink cartridge receiving chamber. An electronic substrate to be connected to the information storage medium via the contact is provided (see, for example, Patent Document 1).

JP-A-2003-266896

DISCLOSURE OF THE INVENTION

Problems to be Solved by the Invention

When the ink cartridge is mounted on the carriage, if the relative position between a terminal of the information storage medium in the ink cartridge and a contact of the carriage is inappropriate (i.e., a misalignment occurs), information about the ink cartridge cannot be properly transmitted and/or received. Therefore, it is necessary to precisely regulate a position where the ink cartridge is mounted in the ink cartridge receiving chamber. This requires strict dimensional control for the carriage, although the carriage is a relatively large component.

If ink leaks out of the ink receiving portion for receiving ink from the ink cartridge in the head unit, the ink leaking out of the head unit reaches the contact, and as a result, information about the ink cartridge may not be transmitted or received.

Accordingly, the invention is made to cope with these circumstances. An object of the invention is to easily form an excellent connection state between a terminal of an information storage medium of an ink cartridge and a contact of a carriage and, additionally, to reliably maintain the excellent connection state.

Means for Solving the Problems

To solve the above problems, a first aspect of the invention provides a carriage including a carriage body that forms a liquid-cartridge receiving chamber that receives a liquid cartridge, a contact provided in the liquid-cartridge receiving chamber, the contact being in contact with a terminal of an information storage medium in the liquid cartridge when the liquid cartridge is mounted, an electronic substrate to be connected to the information storage medium via the contact, and a mounting-position regulating portion that regulates a relative position between the terminal of the information storage medium in the liquid cartridge and the contact by regulating a mounting position of the liquid cartridge in the liquid-cartridge receiving chamber, and the mounting-position regulating portion being independent of the carriage body.

According to this aspect, the mounting-position regulating portion, which regulates the position of the liquid cartridge, is independent of the carriage body so as to be freely removable and attachable with respect to the liquid-cartridge receiving chamber in a state in which the contact and the electronic substrate are mounted. Therefore, the positional relationship between the terminal of the information storage medium in the liquid cartridge and the contact in the liquid-cartridge receiving chamber is not substantially affected by dimensional accuracy of the carriage body and is defined solely by dimensional accuracy of the mounting-position regulating portion as an independent component.

Therefore, an excellent connection state between the terminal of the information storage medium of the liquid cartridge and the contact in the liquid-cartridge receiving chamber can be easily formed. In addition, the mounting-position regulating portion as an independent component can be a common component among carriage bodies having different shapes. This can respond to a request for cost reduction.

In accordance with a second aspect of the invention, in the carriage according to the first aspect, the mounting-position regulating portion is disposed at a wall of the liquid-cartridge receiving chamber, a head unit having a liquid ejecting head that ejects liquid to a target ejecting medium and a liquid receiving portion that receives liquid supplied from the liquid cartridge is formed so as to be attachable to a bottom of the liquid-cartridge receiving chamber, and, in a state in which the head unit and the mounting-position regulating portion are mounted in the liquid-cartridge receiving chamber, the contact inwardly extends from the wall of the liquid-cartridge receiving chamber and is situated above the head unit.

According to this aspect, in a state in which the head unit and the mounting-position regulating portion are mounted in the liquid-cartridge receiving chamber, the contact inwardly extends from the wall of the liquid-cartridge receiving chamber and is situated above the head unit. This can prevent liquid leaking out of the liquid cartridge from reaching the contact from the head unit and can reliably maintain an excellent connection state. In addition, the depth dimension or width dimension of the liquid-cartridge receiving chamber can be reduced. Furthermore, since the mounting-position regulating portion is freely removable and attachable with respect to the liquid-cartridge receiving chamber, the mounting-position regulating portion can remain unattached during mounting of the head unit so as not to interfere therewith. This can facilitate a mounting operation of the head unit even when the mounting-position regulating portion is situated above the head unit.

In accordance with a third aspect of the invention, in the carriage according to the second aspect, the mounting-position regulating portion is disposed on the wall at a front side or a rear side of the carriage in the liquid-cartridge receiving chamber.

According to this aspect, the mounting-position regulating portion is disposed on the wall at the front or rear side of the carriage in the liquid-cartridge receiving chamber. Therefore, the depth dimension of the carriage can be reduced.

In accordance with a fourth aspect of the invention, in the carriage according to any one of the first to third aspects, a predetermined gap is present between the electronic substrate disposed behind the contact and the wall of the liquid-cartridge receiving chamber.

According to this aspect, the predetermined gap is present between the electronic substrate disposed behind the contact and the wall of the liquid-cartridge receiving chamber. This can reduce the possibility of causing ink leaking out of the liquid cartridge to reach the electronic substrate after moving on the wall of the liquid-cartridge receiving chamber.

In accordance with a fifth aspect of the invention, in the carriage according to any one of the first to fourth aspects, a freely openable and closable cover for covering an upper opening of the liquid-cartridge receiving chamber is capable of being partly engaged with a lock portion to be locked to the mounting-position regulating portion or an adjacent section thereto in the liquid cartridge, and, when a locked state of the lock portion is incomplete, the cover pushes the lock portion into a complete locked state by being closed.

According to this aspect, even when the locked state of the lock portion of the liquid cartridge is incomplete, the lock portion is directly pushed into a complete locked state by the cover of the carriage. Therefore, the terminal of the information storage medium in the liquid cartridge and the contact in the liquid-cartridge receiving chamber can be reliably connected to each other. In particular, since the cover of the carriage directly pushes the lock portion or its adjacent section in the liquid cartridge, an incomplete locked state of the liquid cartridge can be reliably corrected.

A sixth aspect of the invention provides a liquid ejecting apparatus for ejecting liquid to a target ejecting medium. The liquid ejecting apparatus includes the carriage according to any one of the first to fifth aspects. According to this aspect, in the liquid ejecting apparatus for ejecting liquid to a target ejecting medium, an operational advantage similar to that of any one of the first to fifth aspects can be attained.

BEST MODE FOR CARRYING OUT THE INVENTION

Embodiments of the invention will be described below with reference to the drawings. First, an ink jet printer (hereinafter referred to as a "printer") 1 being a recording apparatus as one example of a liquid ejecting apparatus according to the invention will be generally described below with reference to FIG. 1. FIG. 1 is a side sectional view of the printer 1. Hereinafter, the left-hand side (the front side of the printer) in FIG. 1 is referred to as a "downstream side" in a paper transport path and the right-hand side (the rear side of the printer) is referred to as an "upstream side".

The printer 1 includes a feeding device 2 capable of setting a recording medium being one example of a "target ejecting medium" (a sheet of recording paper: hereinafter, referred to as a "sheet P") in an inclined attitude at its rear portion. The sheet P is fed from the feeding device 2 to transporting means 4 disposed at the downstream side. The fed sheet P is transported to liquid ejecting means (recording means) 3 by the transporting means 4, and liquid ejection (recording) is performed thereon. The sheet P recorded by the liquid ejecting means 3 is output toward the front of the apparatus by outputting means 5 disposed at the downstream side.

Components of the printer 1 along the paper transport path will be further described below. The feeding device 2 includes a hopper 11, a feeding roller 12, a retarding roller 13, a return lever 14, and other components (not shown).

The hopper 11 is composed of a plate member and can be pivoted about a pivot 11*a* disposed at the upper portion thereof. Pivoting of the hopper 11 causes sheets P supported in an inclined attitude on the hopper 11 to be pressed against the feeding roller 12. The feeding roller 12 has a substantially D-shaped in side view and feeds the pressed topmost sheet P toward the downstream side by use of its arc section.

The retarding roller 13 and the arc section of the feeding roller 12 can be pressed into contact with each other. The retarding roller 13 is disposed so as to receive predetermined rotational resistance (torque) and prevents more than one sheet P from being transported at a time in cooperation with the feeding roller 12. The return lever 14 can be pivoted in the paper transport path in side view. Pivoting of the return lever 14 causes one or more sheets P under the topmost sheet that were almost transported to be returned onto the hopper 11.

Detecting means (not shown) which detects passage of the sheet P and a guide roller 26 which maintains a transported attitude of the sheet P, prevents the sheet P from coming into contact with the feeding roller 12, and reduces a transport load are disposed between the feeding device 2 and the transporting means 4.

The transporting means 4 includes a transport driving roller 30 whose rotation is driven by a motor (not shown) and a transport driven roller 31 driven and rotated by the transport driving roller 30 when being pressed into contact therewith. The transport driven roller 31 is journaled on a downstream side end of an upper paper guide 24 so as to be freely rotatable. A shaft 24*a* of the upper paper guide 24 is journaled in a main frame 7, thus enabling the upper paper guide 24 to pivot about the shaft 24*a* in the paper transport path in side view. The upper paper guide 24 is biased by a coil spring 25 toward a direction in which the transport driven roller 31 is pressed into contact with the transport driving roller 30.

The sheet P that has reached the transporting means 4 is pinched between the transport driving roller 30 and the transport driven roller 31, and the sheet P being in this pinched state is transported to the downstream side as a sub-scanning transport by rotation of the transport driving roller 30.

A recording head 36 as a liquid ejecting head and a front paper guide 37 facing the recording head 36 are disposed downstream of the transporting means 4. The recording head 36 is disposed on the bottom of a carriage 50. The carriage 50 is driven so as to reciprocate in a main-scanning direction by a driving motor (not shown) while being guided by a carriage guide shaft 34 extending along the main-scanning direction. The carriage 50 mounts ink cartridges 35A to 35F (see FIG. 2) as independent "liquid cartridges" corresponding to a plurality of colors thereon and supplies ink to the recording head 36. The details of the structure of the carriage 50 will be described below.

The front paper guide 37 defining the distance between the sheet P and the recording head 36 has a first rib 38*a*, a second rib 38*b*, and a third rib 38*c* at its surface facing the recording head 36 and has grooves 39*a* and 39*b* used for discarding ink. The use of these elements enables recording without margins on the sheet P, a so-called borderless print.

An auxiliary roller 43 and the outputting means 5 are disposed downstream of the recording head 36. The auxiliary roller 43 can be in contact with a recording surface of the sheet P and be driven and rotated in a paper transport path from an area where the recording head 36 and the front paper guide 37 face each other to the outputting means 5. Therefore, the auxiliary roller 43 functions to prevent the sheet P from floating from the front paper guide 37 and to maintain a certain distance between the sheet P and the recording head 36.

The outputting means 5 includes an output driving roller 41 attached on a rotating shaft 40 rotated by power transmitted from a motor (not shown) and an output driven roller 42 driven and rotated in contact with the output driving roller 41. The sheet P recorded by the recording head 36 is pinched between the output driving roller 41 and the output driven roller 42, and, in this state, is outputted toward the front of the apparatus (a stacker (not shown)) by rotation of the output driving roller 41.

The foregoing describes a general structure of the printer 1. The structure of the carriage 50 will now be described below with reference to FIGS. 2 to 9. FIGS. 2(A) and 2(B) are external perspective views of the carriage 50 (FIG. 2(A) illustrates in a state in which a cover is closed and FIG. 2(B) illustrates that in which the cover is opened). FIGS. 3 and 4 are perspective views of a carriage body 51 and an ink cartridge 35. FIG. 5 is an exploded perspective view of the carriage 50. FIG. 6 is a plan view of the carriage body 51. FIG. 7 is a side sectional view of the carriage body 51. FIG. 8 is a cross-sectional view taken along the line a-a shown in FIG. 6. FIG. 9 is a cross-sectional view taken along the line b-b shown in FIG. 6.

As illustrated in FIG. 2, the carriage 50 includes the carriage body 51 and a cover 52. The carriage body 51 has a substantially box shape and is made from a resin material so as to have an ink-cartridge receiving chamber 51*a* for receiving the independent ink cartridges 35Aa to 35F corresponding to a plurality of colors (hereinafter collectively referred to as the "ink cartridge 35" or "each ink cartridge"). The carriage guide shaft 34 passes through the read side of the carriage body 51, thus enabling the carriage body 51 to be guided in the main-scanning direction by the carriage guide shaft 34.

The cover 52 covering an upper opening of the ink-cartridge receiving chamber 51*a* is pivotally attached to the carriage body 51 via a pivoting shaft 52*a* (see FIG. 7). Pivoting of the cover 52 switches between a state in which the upper opening of the ink-cartridge receiving chamber 51*a* is covered (FIG. 2(A)) and a state in which the upper opening thereof is open (FIG. 2(B)). In the cover 52, a reference numeral 52*b* denotes a latch portion. Engagement of the latch portion 52*b* with a stopper 53 of the carriage body 51 holds a closed state.

Each ink cartridge received in the ink-cartridge receiving chamber 51*a* is provided with an electronic substrate 46 (46A to 46F) on which an information storage medium (not shown) retaining various kinds of information regarding each ink cartridge (e.g., an ink color and the amount of ink remaining) is mounted, as illustrated in FIG. 3. The electronic substrate 46 includes terminals to be in contact with contacts 63, which will be described below.

The contacts 63 (see FIG. 8) to be in contact with the terminals of the electronic substrate 46 on each ink cartridge are provided on a wall (a rear wall) of the ink-cartridge receiving chamber 51*a*. An electronic substrate 62 to be connected to the electronic substrate 46 (information storage medium) of each ink cartridge via the contacts 63 is disposed behind the contacts 63 (see FIG. 7). The electronic substrate 46 of each ink cartridge includes the plurality of terminals, and the plurality of contacts 63 are provided corresponding thereto (a detailed drawing is omitted). The contacts 63 and the electronic substrate 62 are attached to a base 61 constituting the basal part of a mounting-position regulating portion 60.

The mounting-position regulating portion 60 is independently formed so as to be freely removable and attachable with respect to the carriage body 51 (ink-cartridge receiving chamber 51*a*), as illustrated in FIG. 5. The basal part of the mounting-position regulating portion 60 is constituted of the base 61. A hook 61*b* is formed behind the base 61, as illustrated in FIG. 9. A latching portion 51*d* is formed at the upper portion of a rear wall 51*c* of the ink-cartridge receiving chamber 51*a*. Engagement of the hook 61*b* with the latching portion 51*d* causes the mounting-position regulating portion 60 to be held in the ink-cartridge receiving chamber 51*a* (mounted in the carriage body 51).

As illustrated in FIG. 8, both walls of the ink-cartridge receiving chamber 51*a* each include a regulating portion (stepped portion) 51*e*. These regulating portions 51*e* regulate the position of the mounting-position regulating portion 60 in the ink-cartridge receiving chamber 51*a* in the direction of its height (the position in a vertical direction in FIG. 8). The both walls of the ink-cartridge receiving chamber 51*a* regulate the position of the mounting-position regulating portion 60 in the ink-cartridge receiving chamber 51*a* in a horizontal direction (the position in a horizontal direction in FIG. 8). As illustrated in FIG. 9, the both walls of the ink-cartridge receiving chamber 51*a* include a regulating portion 51*f*. Cooperation between the regulating portion 51*f* and elasticity of the hook 61*b* regulates the position of the mounting-position regulating portion 60 in the ink-cartridge receiving chamber 51*a* in a forward-rearward direction (the position in a horizontal direction in FIG. 9).

The base 61 constituting the basal part of the mounting-position regulating portion 60 is provided with the contacts 63 and the electronic substrate 62 and also with a plurality of partitions 61*d*, as illustrated in FIG. 6. The partitions 61*d* partition a space for accommodating each of the ink cartridges 35A to 35F together with a plurality of partitions 65 formed at a front wall of the ink-cartridge receiving chamber 51*a*.

An engagement projection 35*c* as a "lock portion" to be locked to the mounting-position regulating portion 60 and a locking lever 35*b* are formed at a surface of the ink cartridge 35 facing the base 61, as illustrated in FIG. 7. The base 61 has a latching portion 61*a* to be engaged with the engagement projection 35. Engagement between these elements holds (locks) a mounted state of the ink cartridge 35 and maintains a contact state between the electronic substrate 46 of the ink cartridge and the contacts 63 of the carriage body. As described above, the mounting-position regulating portion 60 regulates the mounting position of the ink cartridge 35 in the ink-cartridge receiving chamber 51*a*. This regulates the relative position between the connection terminals of the electronic substrate 46 of the ink cartridge and the contacts 63 of the carriage body.

A part of the cover 52 (a lever engagement portion indicated by a reference numeral 52*c*) can be engaged with the locking lever 35*b*. When a locked state is incomplete, more specifically, when the engagement projection 35*c* rides on the top of the latching portion 61*a*, closing the cover 52 causes the engagement projection 35*c* to be pushed in via the locking lever 35*b* and a complete locked state, as illustrated in FIG. 7, is realized. This can prevent the ink cartridge 35 from remaining in an incomplete mounted state. Therefore, each of the connection terminals of the electronic substrate 46 of the ink cartridge and each of the contacts 63 of the carriage body can be constantly and reliably connected to each other.

In particular, according to the present embodiment, because the cover 52 pushes the locking lever 35*b* in at a position adjacent to the pivoting shaft 52*a* for the cover 52, even if all the ink cartridges 35A to 35F are in an incomplete mounted state, all the ink cartridges can be reliably brought into a proper mounted state with a small operating power.

At this time, in order to easily visually identify an incomplete mounted state of the ink cartridge 35, it is preferable that the cover 52 rise a relatively large amount during the incomplete mounted state. One example of such a structure can be that a protrusion (e.g., a rib) that interferes with the main body of the ink cartridge 35 is provided on the cover 52 adjacent to the pivoting shaft 52*a* for the cover 52.

Next, a head unit 55 having the recording head 36 is attached on the bottom of the ink-cartridge receiving chamber 51*a*. The basal part of the head unit 55 is constituted of a base 56. The base 56 is provided with, in addition to the recording head 36, a needle 57 corresponding to each ink cartridge (57A to 57F: see also FIG. 6) as a "liquid receiving portion" to be inserted into an ink supply port 35*a* of each ink cartridge (FIG. 7).

An operational advantage of the carriage 50 having the above structure will now be further described below.

First, since the mounting-position regulating portion 60, which regulates the position of each ink cartridge, is independent of the carriage body 51 so as to be freely removable and attachable with respect to the ink-cartridge receiving chamber 51*a* in a state in which the contacts 63 and the electronic substrate 62 are attached thereto, the positional relationship between the terminals of the electronic substrate 46 of each ink cartridge and the contacts 63 in the ink-cartridge receiving chamber 51*a* is not substantially affected by dimensional accuracy of the carriage body 51 and is defined solely by dimensional accuracy of the base 61 as an independent component. As a result, an excellent connection state between each of the terminals of the electronic substrate 46 of each ink cartridge and each of the contacts 63 in the ink-cartridge receiving chamber 51*a* can be easily formed.

Next, the positional relationship to the head unit 55 will be described below. As illustrated in FIG. 7, in a state in which the head unit 55 and the mounting-position regulating portion 60 are attached to the ink-cartridge receiving chamber 51*a*, the contacts 63 inwardly extend from the wall 51*c* of the ink-cartridge receiving chamber 51*a* and are situated above the head unit 55. This structure can prevent ink leaking out of each ink cartridge from reaching the contacts 63 from the head unit 55.

Therefore, an excellent connection state between the terminal of the electronic substrate 46 of each ink cartridge and the contact 63 in the ink-cartridge receiving chamber 51*a* can be reliably maintained for the long term, while at the same time the depth dimension of the ink-cartridge receiving chamber 51*a* can be reduced.

In particular, since a predetermined gap is present between the electronic substrate 62 disposed behind the contacts 63 and the wall 51*c* of the ink-cartridge receiving chamber 51*a*, as illustrated in FIG. 7, the possibility of causing ink leaking out of each ink cartridge to reach the electronic substrate 62 after moving on the wall 51*c* can be reduced.

In addition, since the mounting-position regulating portion 60 is freely removable and attachable with respect to the ink-cartridge receiving chamber 51*a*, the mounting-position regulating portion 60 can remain unattached during mounting of the head unit 55 so as not to interfere therewith. This can facilitate a mounting operation of the head unit 55.

BRIEF DESCRIPTION OF THE DRAWINGS

FIG. 2(A) illustrates a state in which a cover is closed and FIG. 2(B) illustrates a state in which the cover is opened.

Figure 1:
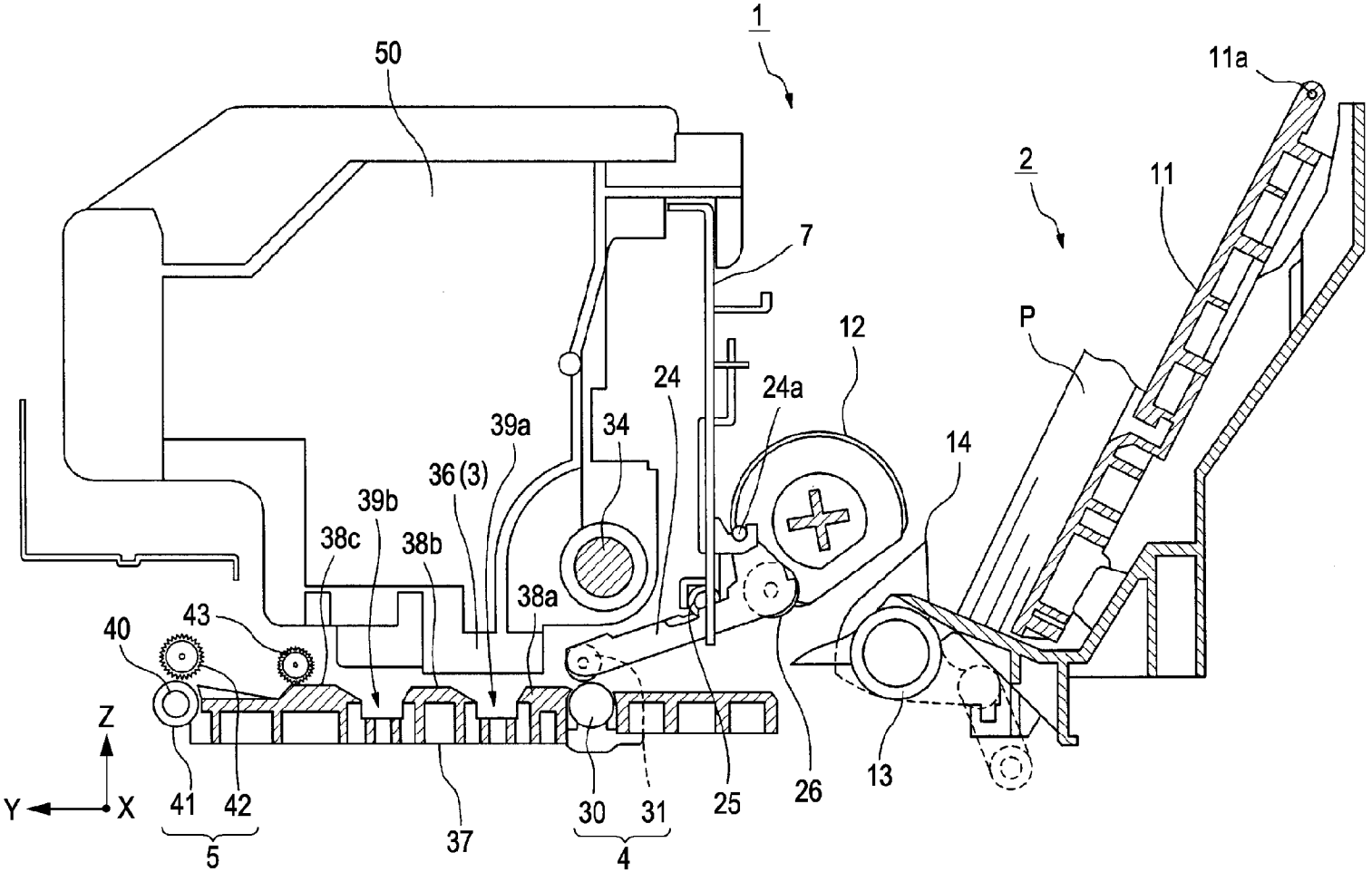
FIG. 1 is a side sectional view of a printer according to the invention.
Figure 2:
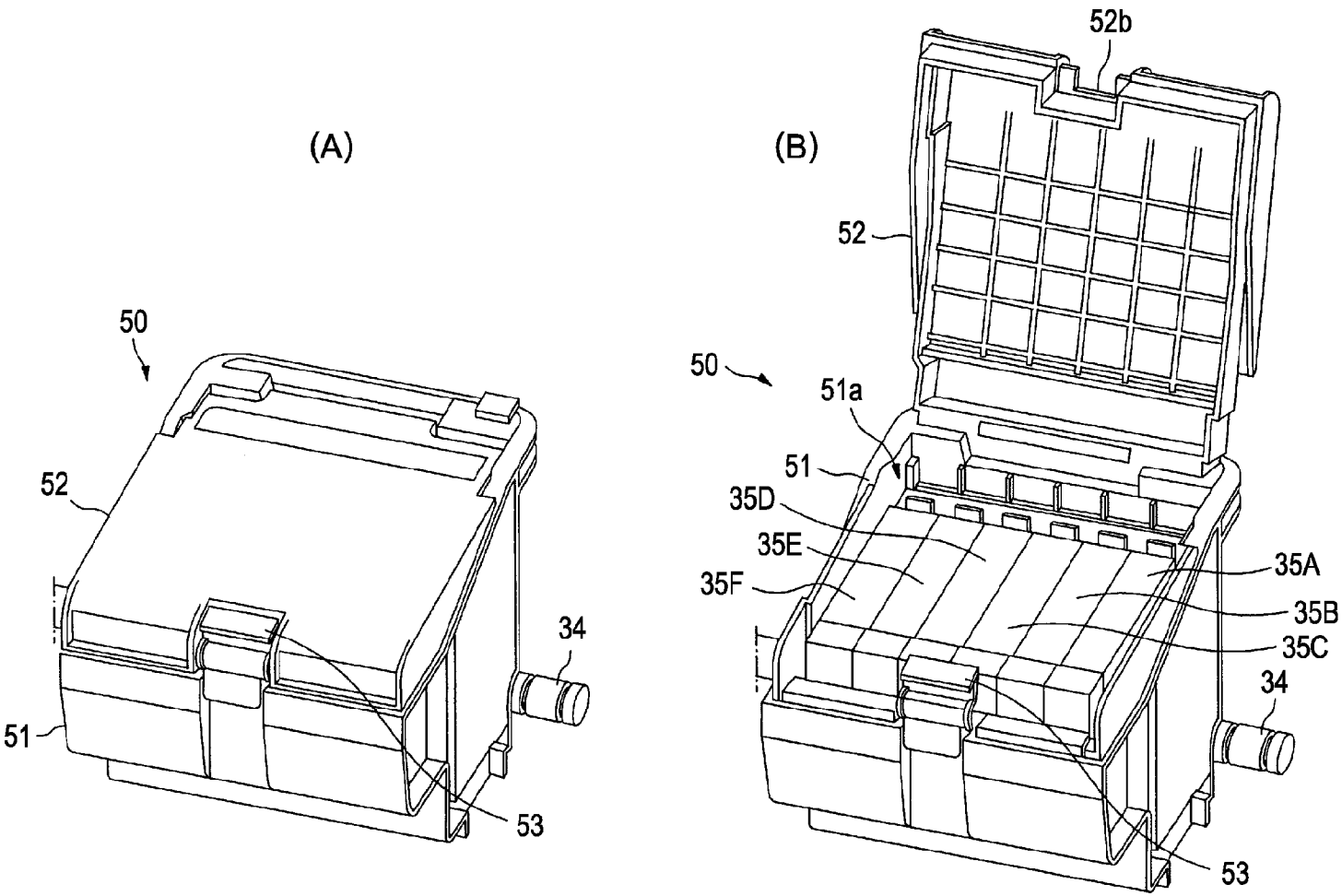
FIG. 2 are external perspective views of a carriage according to the invention.
Figure 3:
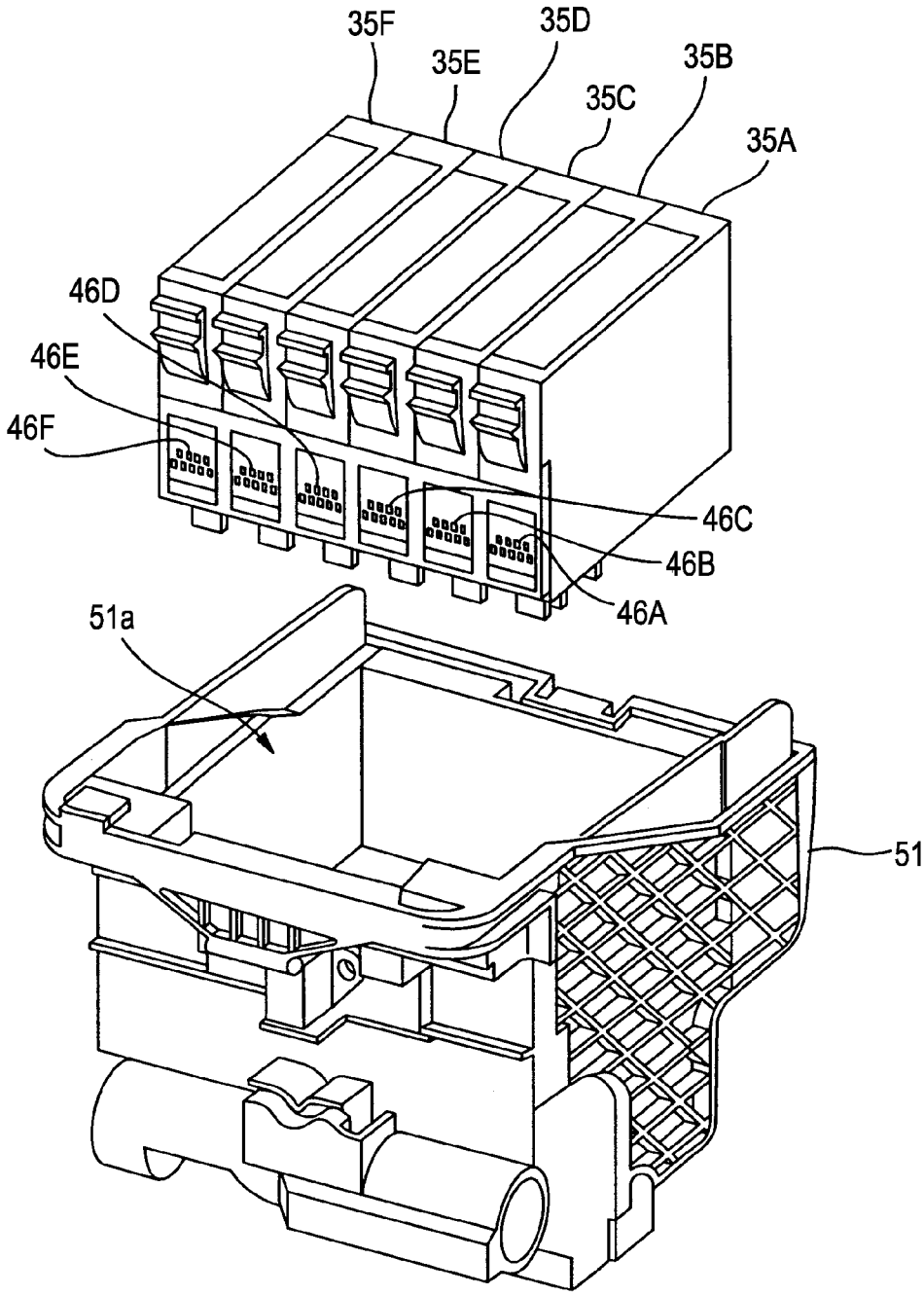
FIG. 3 is a perspective view of a carriage body and an ink cartridge according to the invention.
Figure 4:
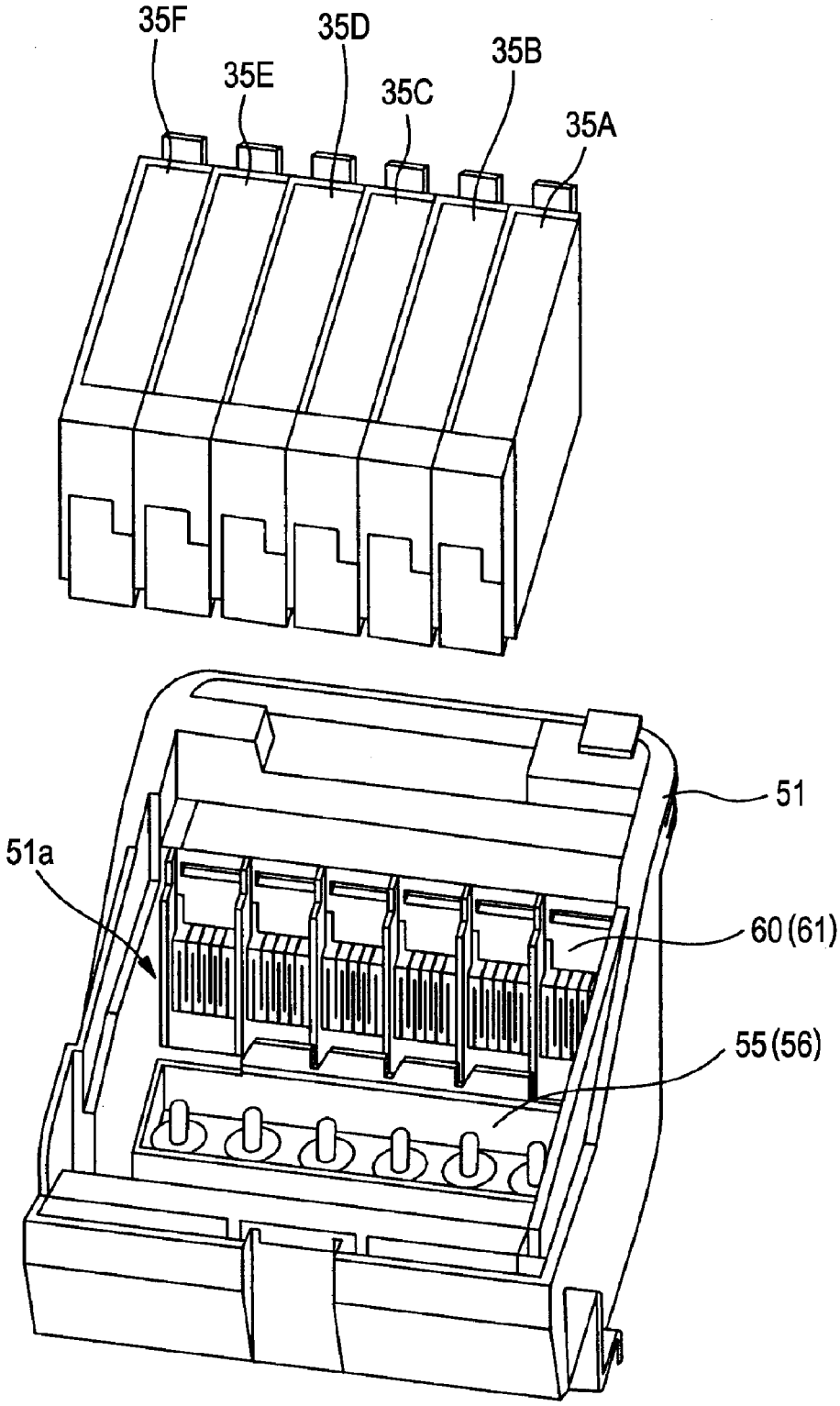
FIG. 4 is a perspective view of the carriage body and the ink cartridge according to the invention.
Figure 5:
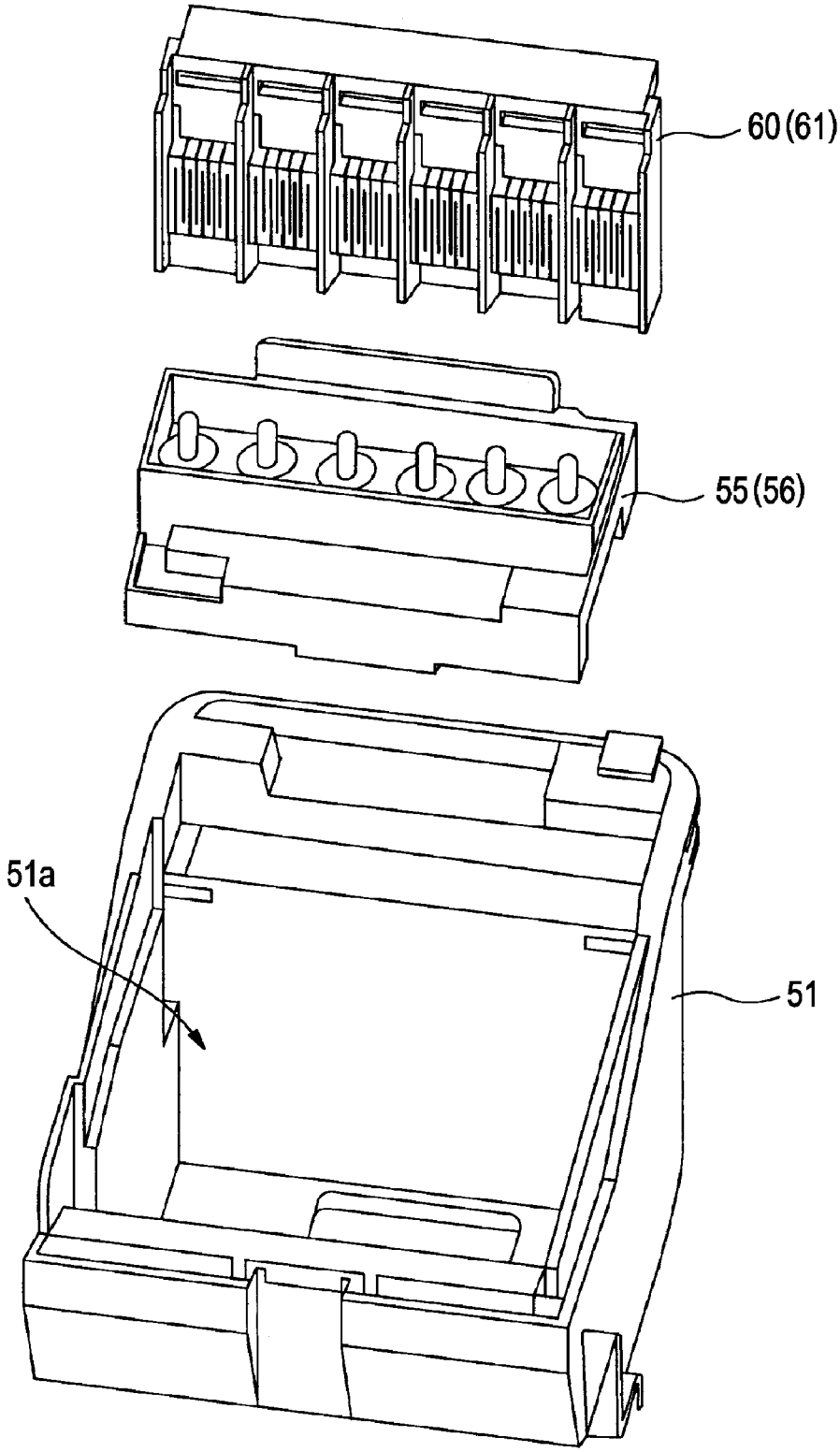
FIG. 5 is an exploded perspective view of the carriage according to the invention.
Figure 6:
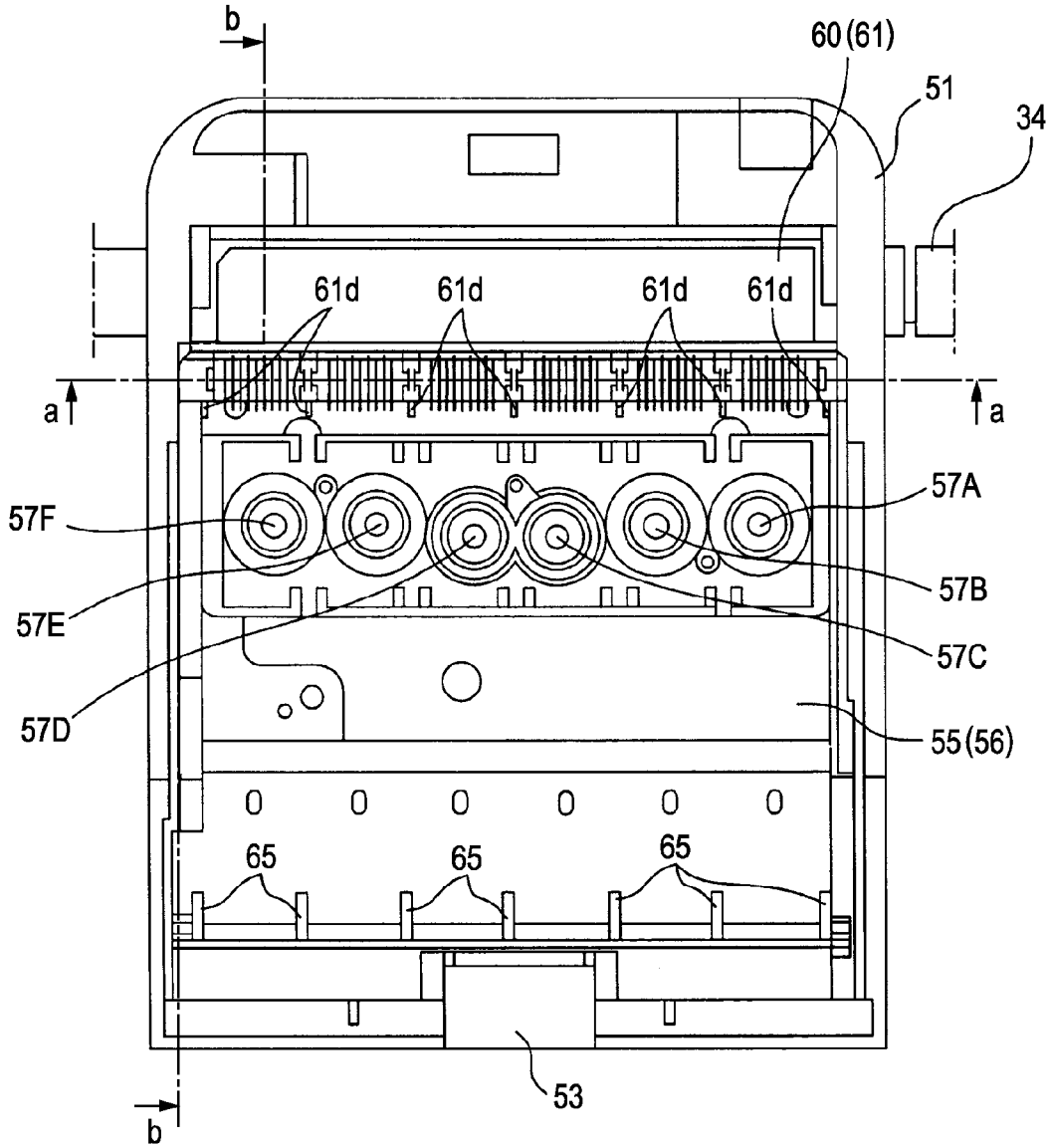
FIG. 6 is a plan view of the carriage body according to the invention.
Figure 7:
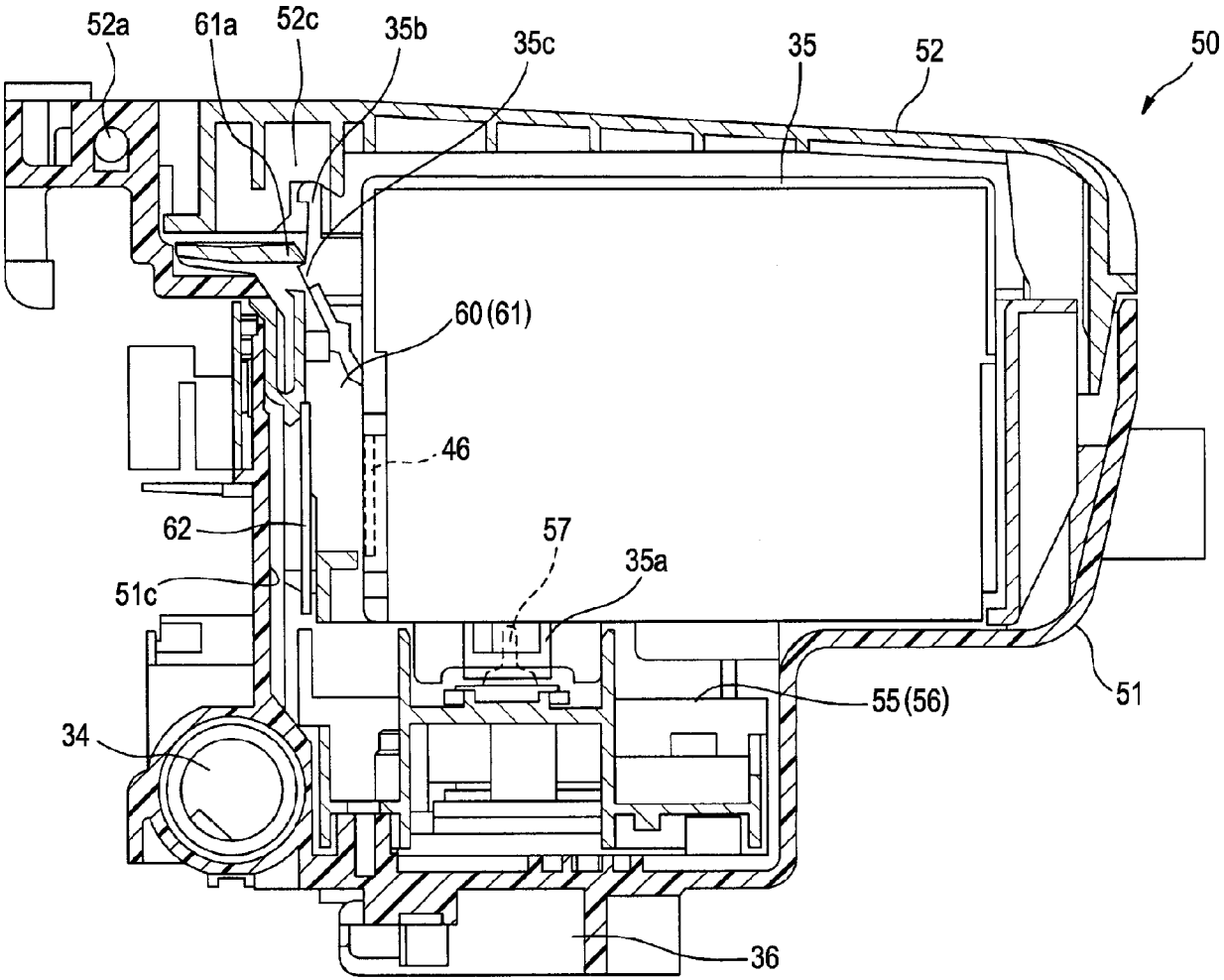
FIG. 7 is a side sectional view of the carriage body according to the invention.
Figure 8:
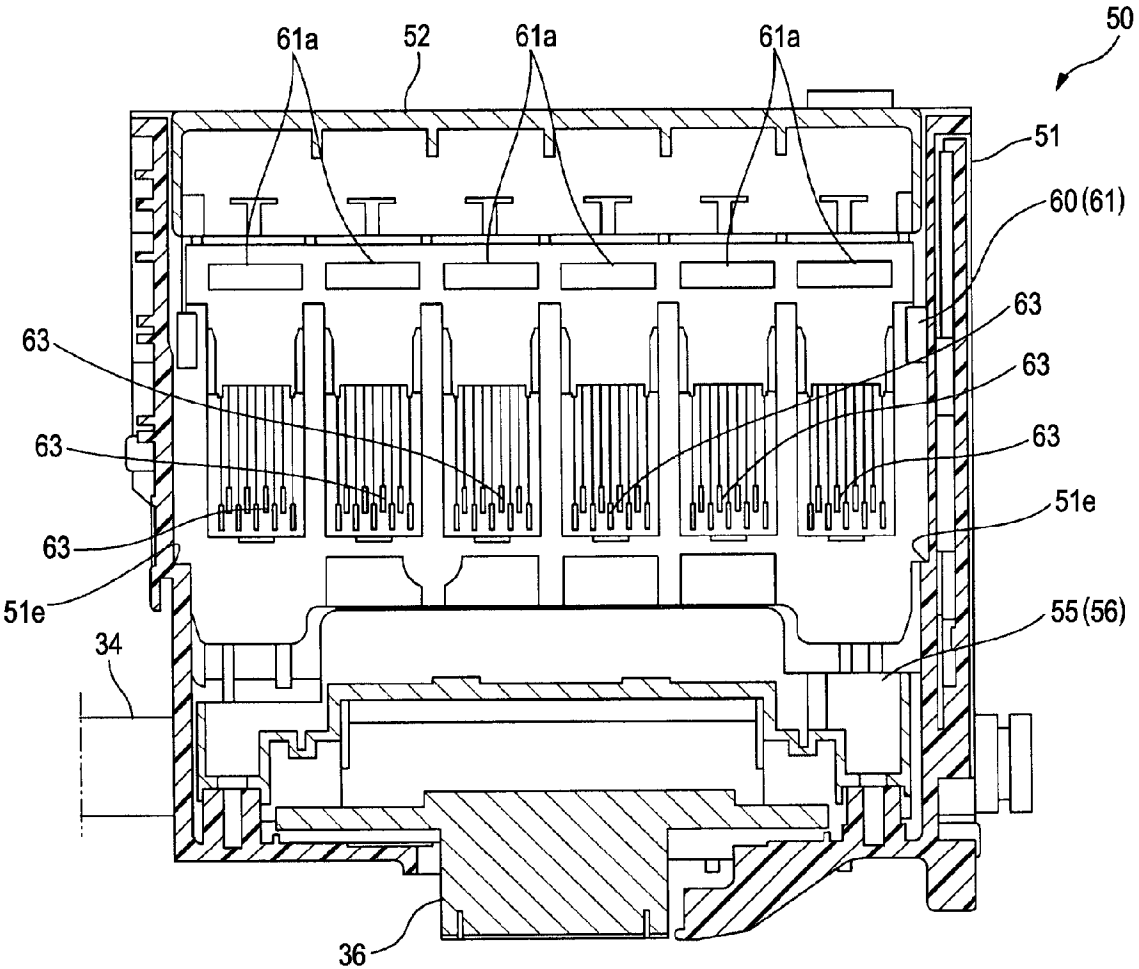
FIG. 8 is a cross-sectional view taken along the line a-a shown in FIG. 6.
Figure 9:
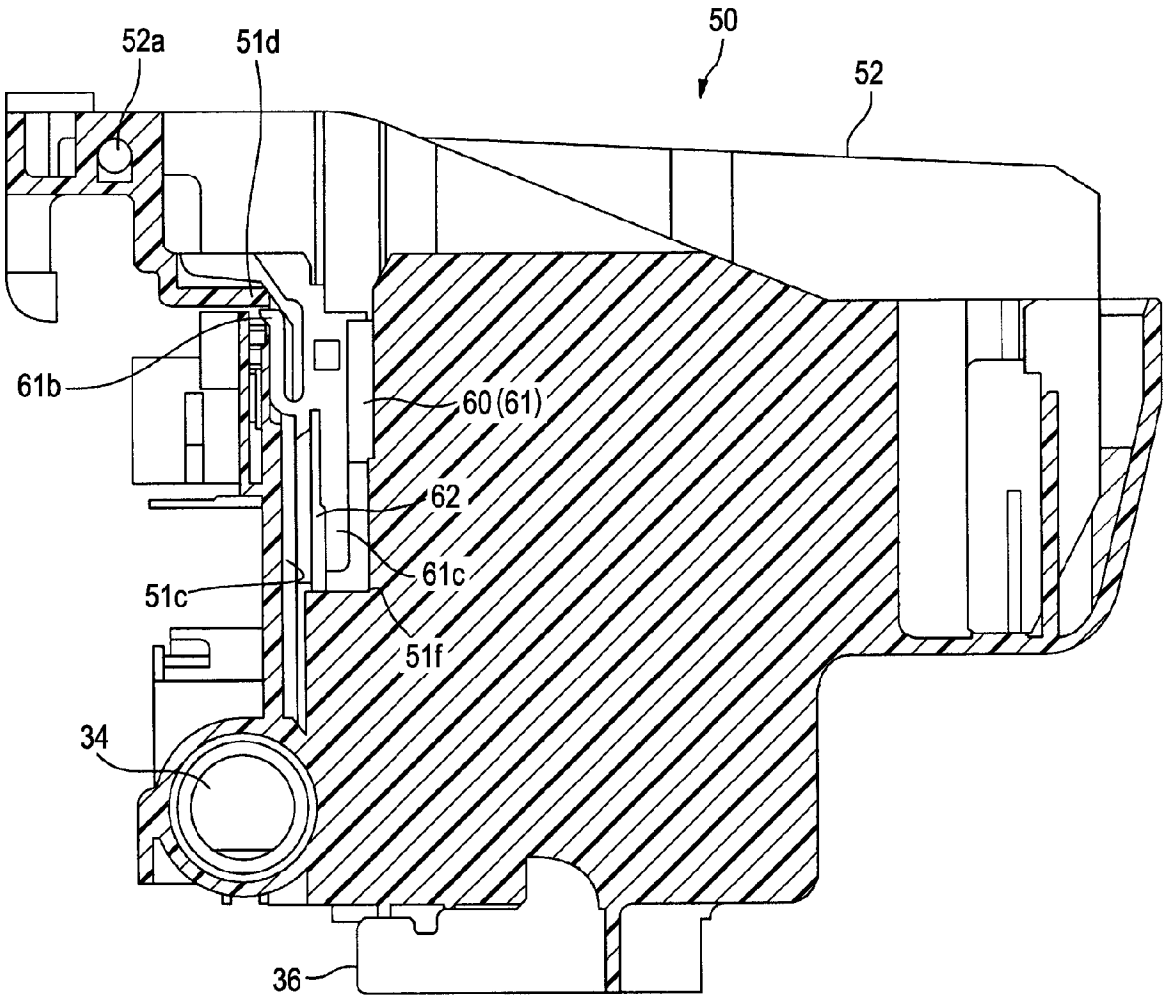
FIG. 9 is a cross-sectional view taken along the line b-b shown in FIG. 6.

The invention claimed is:

1. A carriage comprising:

a carriage body that forms a liquid-cartridge receiving chamber that receives a liquid cartridge;

a contact provided in the liquid-cartridge receiving chamber, the contact being in contact with a terminal of an information storage medium in the liquid cartridge when the liquid cartridge is mounted;

an electronic substrate to be connected to the information storage medium via the contact; and a mounting-position regulating portion that regulates a mounting position of the liquid cartridge in the liquid-cartridge receiving chamber and regulates a relative position between the terminal of the information storage medium in the liquid cartridge and the contact, wherein the mounting-position regulating portion is independent of the carriage body.

2. The carriage according to claim 1, wherein the mounting-position regulating portion is disposed at a wall of the liquid-cartridge receiving chamber, wherein a head unit having a liquid ejecting head that ejects liquid to a target ejecting medium and a liquid receiving portion that receives liquid supplied from the liquid cartridge is formed so as to be attachable to a bottom of the liquid-cartridge receiving chamber, and wherein, in a state in which the head unit and the mounting-position regulating portion are mounted in the liquid-cartridge receiving chamber, the contact inwardly extends from the wall of the liquid-cartridge receiving chamber and is situated above the head unit.

3. The carriage according to claim 2, wherein the mounting-position regulating portion is disposed on the wall at a front side or a rear side of the carriage in the liquid-cartridge receiving chamber.

4. The carriage according to claim 3, wherein a predetermined gap is present between the electronic substrate disposed behind the contact and the wall of the liquid-cartridge receiving chamber.

5. The carriage according to claim 2, wherein a predetermined gap is present between the electronic substrate disposed behind the contact and the wall of the liquid-cartridge receiving chamber.

6. The carriage according to claim 1, wherein a predetermined gap is present between the electronic substrate disposed behind the contact and the wall of the liquid-cartridge receiving chamber.

7. The carriage according to claim 6, wherein a freely openable and closable cover for covering an upper opening of the liquid-cartridge receiving chamber is capable of being partly engaged with a lock portion to be locked to the mounting-position regulating portion or an adjacent section thereto in the liquid cartridge, and wherein, when a locked state of the lock portion is incomplete, the cover pushes the lock portion into a complete locked state by being closed.

8. The carriage according claim 1, wherein a freely openable and closable cover for covering an upper opening of the liquid-cartridge receiving chamber is capable of being partly engaged with a lock portion to be locked to the mounting-position regulating portion or an adjacent section thereto in the liquid cartridge, and wherein, when a locked state of the lock portion is incomplete, the cover pushes the lock portion into a complete locked state by being closed.

9. A liquid ejecting apparatus for ejecting liquid to a target ejecting medium, the liquid ejecting apparatus comprising a carriage that includes:

a carriage body that forms a liquid-cartridge receiving chamber that receives a liquid cartridge;

a contact provided in the liquid-cartridge receiving chamber, the contact being in contact with a terminal of an information storage medium in the liquid cartridge when the liquid cartridge is mounted;

an electronic substrate to be connected to the information storage medium via the contact; and a mounting-position regulating portion that regulates a mounting position of the liquid cartridge in the liquid-cartridge receiving chamber and regulates a relative position between the terminal of the information storage medium in the liquid cartridge and the contact, wherein the mounting-position regulating portion is independent of the carriage body.

10. The liquid ejecting apparatus according to claim 9, wherein the mounting-position regulating portion is disposed at a wall of the liquid-cartridge receiving chamber, wherein a head unit having a liquid ejecting head that ejects liquid to a target ejecting medium and a liquid receiving portion that receives liquid supplied from the liquid cartridge is formed so as to be attachable to a bottom of the liquid-cartridge receiving chamber, and wherein, in a state in which the head unit and the mounting-position regulating portion are mounted in the liquid-cartridge receiving chamber, the contact inwardly extends from the wall of the liquid-cartridge receiving chamber and is situated above the head unit.

11. The liquid ejecting apparatus according to claim 10, wherein the mounting-position regulating portion is disposed on the wall at a front side or a rear side of the carriage in the liquid-cartridge receiving chamber.

12. The liquid ejecting apparatus according to claim 11, wherein a predetermined gap is present between the electronic substrate disposed behind the contact and the wall of the liquid-cartridge receiving chamber.

13. The liquid ejecting apparatus according to claim 10, wherein a predetermined gap is present between the electronic substrate disposed behind the contact and the wall of the liquid-cartridge receiving chamber.

14. The liquid ejecting apparatus according to claim 9, wherein a predetermined gap is present between the electronic substrate disposed behind the contact and the wall of the liquid-cartridge receiving chamber.

15. The liquid ejecting apparatus according to claim 14, wherein a freely openable and closable cover for covering an upper opening of the liquid-cartridge receiving chamber is capable of being partly engaged with a lock portion to be locked to the mounting-position regulating portion or an adjacent section thereto in the liquid cartridge, and wherein, when a locked state of the lock portion is incomplete, the cover pushes the lock portion into a complete locked state by being closed.

16. The liquid ejecting apparatus according to claim 9, wherein a freely openable and closable cover for covering an upper opening of the liquid-cartridge receiving chamber is capable of being partly engaged with a lock portion to be locked to the mounting-position regulating portion or an adjacent section thereto in the liquid cartridge, and wherein, when a locked state of the lock portion is incomplete, the cover pushes the lock portion into a complete locked state by being closed.

* * * * *